US011992100B2

(12) United States Patent
Haythornthwaite

(10) Patent No.: US 11,992,100 B2
(45) Date of Patent: May 28, 2024

(54) UMBRELLA HAVING ANTI-INVERSION MECHANISM

(71) Applicant: Shedrain Corporation, Portland, OR (US)

(72) Inventor: David Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 130 days.

(21) Appl. No.: 17/283,874

(22) PCT Filed: Oct. 24, 2019

(86) PCT No.: PCT/US2019/057795
§ 371 (c)(1),
(2) Date: Apr. 8, 2021

(87) PCT Pub. No.: WO2020/086806
PCT Pub. Date: Apr. 30, 2020

(65) Prior Publication Data

US 2021/0378372 A1 Dec. 9, 2021

Related U.S. Application Data

(60) Provisional application No. 62/749,852, filed on Oct. 24, 2018.

(51) Int. Cl.
*A45B 25/22* (2006.01)
*A45B 19/10* (2006.01)
(Continued)

(52) U.S. Cl.
CPC ..... *A45B 25/22* (2013.01); *A45B 19/10* (2013.01); *A45B 25/02* (2013.01); *A45B 2019/004* (2013.01)

(58) Field of Classification Search
CPC ..... A45B 19/10; A45B 25/22
See application file for complete search history.

(56) References Cited

U.S. PATENT DOCUMENTS 559,577 A 5/1896 Hadfield
1,104,598 A 7/1914 Wyskosky
(Continued)

FOREIGN PATENT DOCUMENTS

CN 203152755 8/2013
CN 206025463 U 3/2017
(Continued)

OTHER PUBLICATIONS

International Search Report and Written Opinion in PCT Application No. PCT/US2021/057853, dated Feb. 2, 2022.
(Continued)

*Primary Examiner* — Noah Chandler Hawk
(74) *Attorney, Agent, or Firm* — Leason Ellis LLP

(57) ABSTRACT

An umbrella includes an anti-inversion mechanism that is configured to apply to each rib assembly a force that counters an inversion force that is applied to the umbrella. The anti-inversion mechanism includes a flexible elongated structure that is disposed exteriorly along the second rib part and has a first bent end that is attached to the second rib part by passing through an opening formed in the second rib part and being anchored within a hollow interior of the second rib part. The mechanism further includes a flexible wire having a first end attached to the flexible elongated structure of the anti-inversion mechanism and a second end attached to a rib tip that is located at a free distal end of the rib assembly.

16 Claims, 5 Drawing Sheets

(51) Int. Cl.
*A45B 25/02* (2006.01)
*A45B 19/00* (2006.01)

(56) References Cited

U.S. PATENT DOCUMENTS

| | | | |
|---|---|---|---|
| 1,444,017 | A | 2/1923 | Waschek |
| 2,616,439 | A | 11/1952 | Richard |
| 2,833,297 | A | 5/1958 | Tibony |
| 4,456,023 | A | 6/1984 | Fujihashi |
| 4,779,896 | A | 10/1988 | Ingalls |
| 4,934,395 | A | 6/1990 | Wu |
| 5,305,771 | A | 4/1994 | Wilk |
| 5,720,311 | A | 2/1998 | Lin et al. |
| 5,791,359 | A | 8/1998 | Lin |
| 5,842,493 | A | 12/1998 | Yakubisin |
| 6,016,822 | A | 1/2000 | Lin |
| 6,058,952 | A | 5/2000 | Lin et al. |
| 6,089,244 | A | 7/2000 | Ko |
| 6,112,755 | A | 9/2000 | Lin |
| 6,186,157 | B1 | 2/2001 | Lin et al. |
| 6,338,353 | B1 | 1/2002 | Chen |
| 6,343,568 | B1 | 2/2002 | McClasky |
| 6,360,759 | B1 | 3/2002 | Lin et al. |
| 6,497,242 | B1 | 12/2002 | Lin et al. |
| 6,588,439 | B2 | 7/2003 | Wu |
| 6,863,081 | B2 | 3/2005 | Hsieh |
| 6,948,506 | B2 | 9/2005 | Wang |
| 7,415,986 | B2 | 8/2008 | Wu |
| 7,527,063 | B1 | 5/2009 | Chen |
| 7,588,042 | B2 | 9/2009 | Chang |
| 9,301,582 | B2 | 4/2016 | Haythornthwaite et al. |
| 9,486,044 | B1 | 11/2016 | Dai |
| 9,609,926 | B2 | 4/2017 | Haythornthwaite et al. |
| 9,629,426 | B1 | 4/2017 | Dai |
| 9,788,617 | B1 | 10/2017 | Chen |
| 9,839,268 | B2 | 12/2017 | Chen |
| 10,258,120 | B2 | 4/2019 | Crayton |
| 10,716,372 | B1 | 7/2020 | Li |
| 11,006,711 | B2 | 5/2021 | Haythornthwaite |
| 2002/0157695 | A1 | 10/2002 | Hseih |
| 2003/0005951 | A1 | 1/2003 | Wu |
| 2003/0029485 | A1 | 2/2003 | Johnson et al. |
| 2004/0149326 | A1 | 8/2004 | Hsieh |
| 2004/0238020 | A1 | 12/2004 | Lee |
| 2005/0236024 | A1 | 10/2005 | Wu |
| 2008/0149153 | A1 | 6/2008 | Chang |
| 2011/0108074 | A1 | 5/2011 | You |
| 2012/0016028 | A1 | 6/2012 | Wang |
| 2013/0228203 | A1 | 9/2013 | David |
| 2015/0096601 | A1 | 4/2015 | Haythornthwaite et al. |
| 2016/0135555 | A1 | 5/2016 | Haythornthwaite |
| 2017/0196324 | A1 | 7/2017 | Haythornthwaite et al. |
| 2017/0215535 | A1 | 8/2017 | Chen et al. |
| 2020/0128930 | A1 | 4/2020 | Haythornthwaite |
| 2020/0288829 | A1 | 9/2020 | Haythornthwaite |
| 2021/0227941 | A1 | 7/2021 | Haythornthwaite |

FOREIGN PATENT DOCUMENTS

| | | |
|---|---|---|
| CN | 207306272 | 5/2018 |
| CN | 207306727 | 5/2018 |
| FR | 2844430 | 3/2004 |
| GB | 2120547 | 12/1983 |
| GB | 2185682 A | 7/1987 |
| GB | 2425254 | 10/2006 |
| JP | S51-127333 | 11/1976 |
| JP | H06-105708 | 4/1994 |
| JP | 3007819 | 2/1995 |
| JP | H10-179223 | 7/1998 |
| JP | 2002-101931 | 4/2002 |
| JP | 2002336018 | 11/2002 |
| KR | 200439380 | 4/2008 |
| KR | 20110005299 | 5/2011 |

OTHER PUBLICATIONS

Final Office Action in U.S. Appl. No. 17/231,408, dated Jul. 6, 2022 (18 pages).

Non Final Office Action in U.S. Appl. No. 17/517,991, dated May 23, 2023 (8 pages).

Extended European Search Report in EP Application No. 21781330.2-1015/4125490, mailed Feb. 15, 2024 (8 pages).

UMBRELLA HAVING ANTI-INVERSION MECHANISM

This application is a U.S. National Phase Application under 35 U.S.C. § 371 of International Patent Application No. PCT/US2019/057795, filed Oct. 24, 2019, which is based on and claims priority to U.S. Provisional Patent Application 62/749,852, filed Oct. 24, 2018, each of which are incorporated by reference herein as if expressly set forth in their respective entirety herein.

TECHNICAL FIELD

The present invention relates to umbrellas and more particularly, relates to an umbrella rib assembly having an anti-inversion feature.

BACKGROUND

As is well known, an umbrella is a device that protects the user from the elements and in particular from liquid and frozen precipitation or even the sun, etc. A traditional umbrella has the following parts: a pole, a canopy, ribs, a runner, springs and a ferrule. A pole is the metal or wooden shaft that runs between the umbrella's handle at the bottom (or the base stand in the case of a patio model) and the canopy at the top. The canopy is the fabric part of the umbrella that catches the rain, the wind and the sun. The ribs are what give an umbrella its structure and shape. Outer ribs hold up the canopy and inner ribs (sometimes called stretchers) act as supports and connect the outer ribs to the umbrella pole. A runner slides up and down the pole while connected to the ribs/stretchers, and is responsible for the opening and closing of the canopy. Many umbrella designs include a top spring to hold the runner up when the canopy is open, a bottom spring to hold the runner down when the canopy is closed, and sometimes a center ball spring to extend the pole length in telescopic models. Strictly ornamental, the finial (also called the ferrule) is found on the very top of the umbrella, above the canopy.

Umbrella ribs function in a folding construction supporting the umbrella canopy fabric. Under normal operating conditions, the forces acting on the umbrella canopy fabric increase toward peak values when the canopy becomes fully deployed and when wind gusts tend to overturn the canopy. These forces are transmitted from the canopy to the canopy ribs, and can act on the ribs in opposite directions depending on the direction of the wind. The ribs thus have to be strong enough to withstand forces which can act on them from anyone of the two main opposite directions.

In addition to their strength requirements, the shape of the umbrella ribs should change between a substantially straight contour when the umbrella is folded and a curved one, when the canopy if fully deployed. The straight design is aimed to allow the folded fibs to lay parallel to the shaft of the umbrella when the umbrella is folded and the curved design provides for the typical mushroom-like shape (also called bell shaped).

SUMMARY

In one aspect of the present disclosure, an umbrella is provided and includes an elongated shaft having a first end and an opposite second end and a runner slidably disposed about the elongated shaft. The umbrella includes a plurality of rib assemblies, with each rib assembly including a first rib part, a second rib part and a third rib part. The rib assembly is attached to the runner by a strut that moves between open and closed positions in which in the open position, the first, second and third rib parts are in an open, extended position and in the closed position, the first, second and third rib parts are in a closed, collapsed position.

The umbrella further includes an anti-inversion mechanism that is configured to apply to each rib assembly a force that counters an inversion force that is applied to the umbrella. The anti-inversion mechanism includes a flexible elongated structure that is disposed exteriorly along the second rib part and has a first bent end that is attached to the second rib part by passing through an opening formed in the second rib part and being anchored within a hollow interior of the second rib part. The mechanism further includes a flexible wire having a first end attached to the flexible elongated structure of the anti-inversion mechanism and a second end attached to a rib tip that is located at a free distal end of the rib assembly.

BRIEF DESCRIPTION OF THE DRAWING FIGURES

DETAILED DESCRIPTION OF CERTAIN EMBODIMENTS

As discussed herein, the present invention is directed to improvement with respect to a number of components of an umbrella including but not limited to a shaft construction and a rib assembly thereof. As discussed herein, the features of the present invention can be implemented with both a manual type umbrella and an automatic type umbrella. In addition, the other features can be implemented with other types of umbrellas. Accordingly, the following discussion and figures describe exemplary embodiments that implement the teachings of the present invention.

Figure 1:
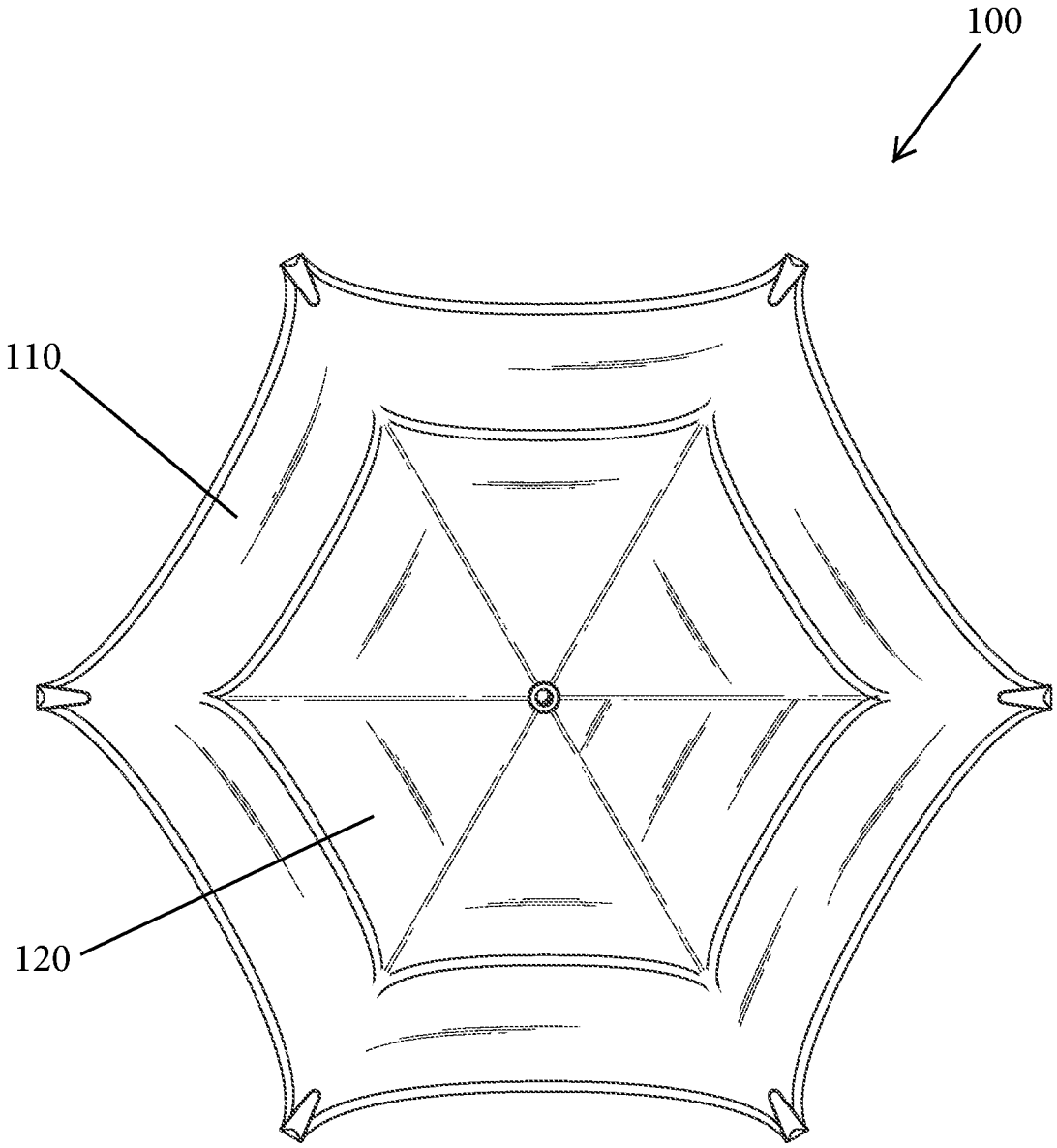
FIG. 1 is a top plan view of an exemplary dual canopy umbrella in accordance with the present invention.
Figure 2:
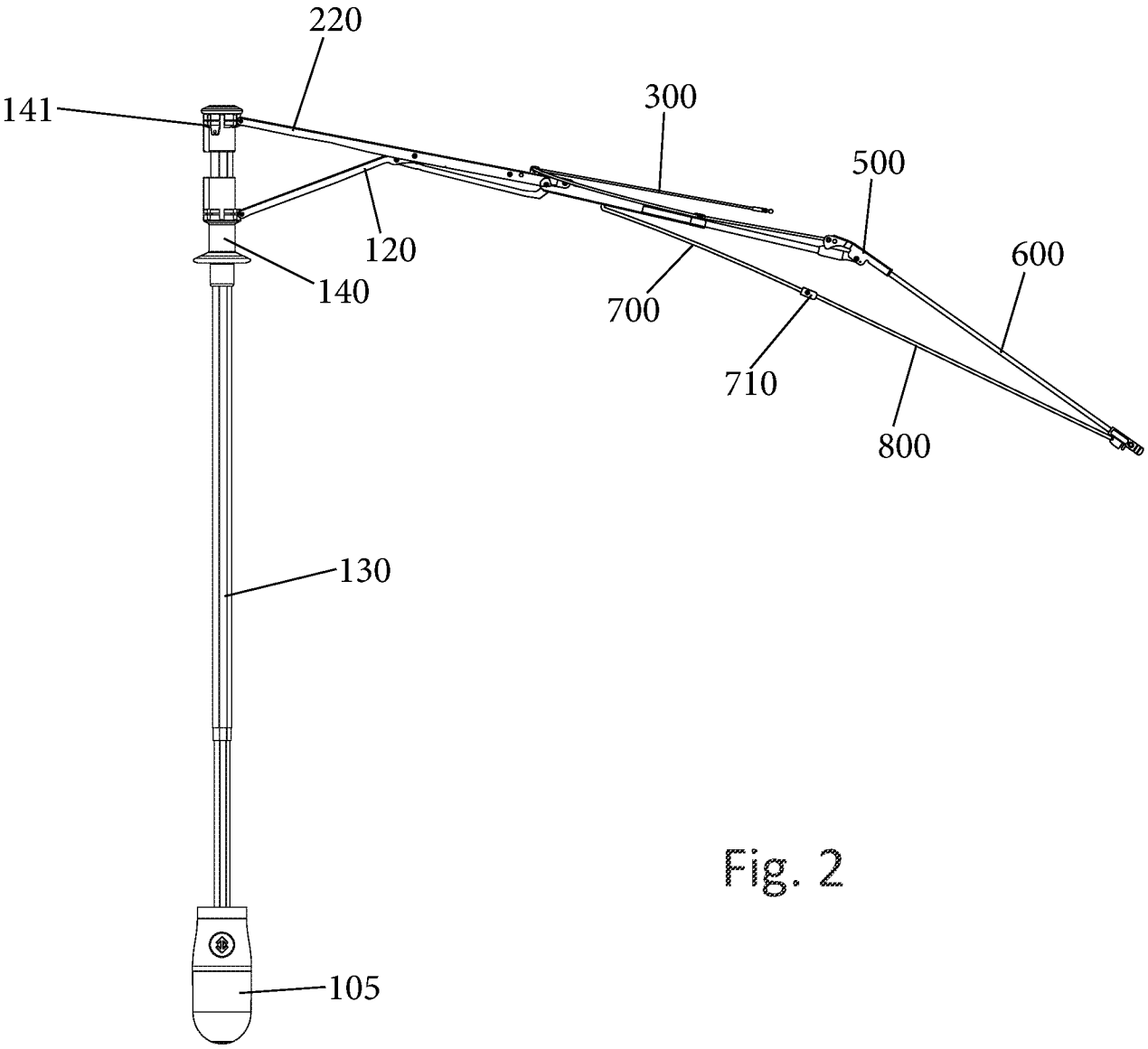
FIG. 2 is a side elevation view of a shaft, runner and rib assembly with an anti-inversion mechanism without the canopies being shown and being shown in an extended position.
Figure 4:
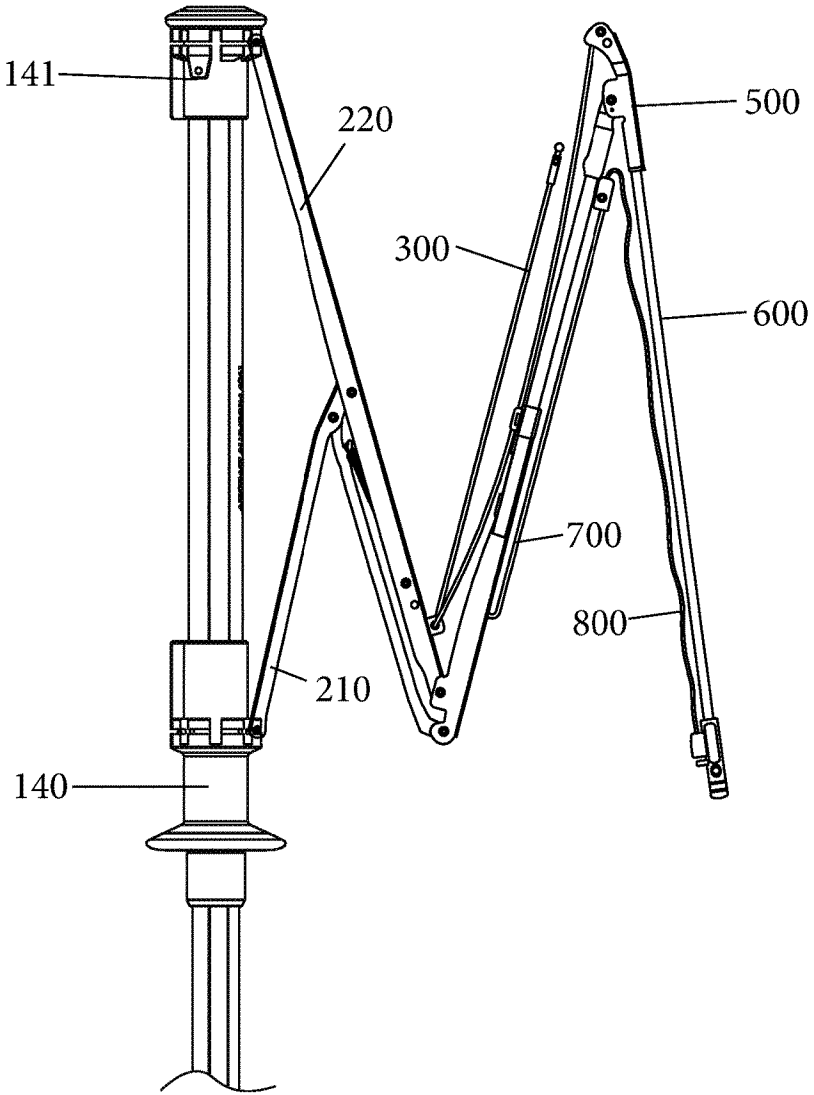
FIG. 4 is a close-up view showing the runner and rib assembly in the partially closed position.
Figure 3:
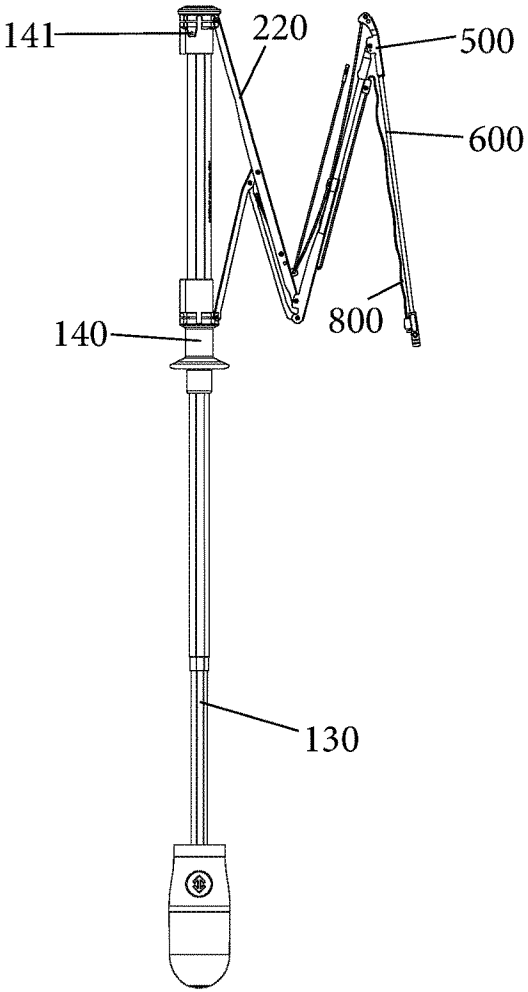
FIG. 3 is a side elevation view showing the runner and rib assembly in a partially closed position.

FIG. 1 shows a top plan view of an umbrella 100 in accordance with one exemplary embodiment of the present invention with multiple rib assemblies being shown and FIG. 2 is a side elevation view showing the umbrella 100 without the canopy. The umbrella 100 includes a shaft 130 that has a first (top) end and an opposite second (bottom) end. The shaft 130 itself can be formed of any number of different components to cooperate to provide shaft 130 and the shaft 130 illustrated in FIG. 2 is part of a manual umbrella assembly in which the user manually opens and closes the umbrella. At the first end of the shaft, a cap 141 can be provided to close off the shaft 130 and at the second end, a handle 105 is provided for grasping by the user. A movable runner 140 is provided along the shaft 130.

The umbrella 100 can be of a dual canopy design in that there is a first canopy 110 that acts as the main canopy and a second canopy 120 that acts as a secondary canopy. Both the first canopy 110 and the second canopy 120 are anchored to the cap at the top of the shaft along their innermost portions, with the second canopy 120 also be attached about its periphery at select locations to the first canopy 110 as described herein. It will be appreciated that the shape and size of the illustrated canopies are only exemplary and not limiting of the present invention. Thus, FIG. 1 shows just one exemplary dual canopy design and is not limiting. The outer periphery of the second canopy 120 can be disposed along the bottom surface of the first canopy 110 and as is known in the art, the first canopy can thus have a center open which is covered by the second canopy but the dual canopy design acts as a vent since the seam between the two canopies is open at select locations to allow venting.

The first canopy 110 has a large center opening over which the second canopy 120 is disposed so as to define a vent between the two canopies and the peripheral outer edge of the second canopy 120 overlies the first canopy 110.

The umbrella 100 includes a plurality of rib assemblies that are coupled to both the cap and the runner 140 and this results in the opening and closing of the rib assembly 200 and the attached canopy (not shown) based on the direction of movement of the runner 140. As described herein, each rib assembly is defined by a number of rib parts that are pivotally attached to another to allow for the collapsing and extension of the rib assembly in response to opening and closing of the canopy by the runner 140.

The connection between the rib assembly and the runner 140 is made by a first strut 210. The strut 210 is an elongated structure that has a first end 212 and an opposite second end 214, with the second end 214 being pivotally attached to the rib assembly, as discussed herein, and the first end 212 being pivotally attached to the runner 140. The pivotal connection between the first strut 210 and the runner 140 and between the first strut 210 and the rib assembly can be accomplished with a fastener, such as a rivet or pin, etc. More specifically, a first strut joint (first connection point/pivot) 225 is formed between the first strut 210 and the rib assembly at second end 214 and a similar strut joint can be formed between the first strut 210 and the runner 140 at the first end 212.

The first strut 210 can be formed of any number of different materials including a metal (e.g., a zinc alloy).

As shown in FIGS. 2-6, the rib assembly can be formed of a number of elongated rib components (parts) that are coupled to one another and to other components of the umbrella to provide a rib assembly that opens and closes. In the illustrated embodiment, each rib assembly includes a plurality of rib parts and more particularly, the rib assembly includes three distinct rib parts, namely, a first rib part 220, a second rib part 400, and a third rib part 600.

The first rib part 220 includes a first end 222 and an opposing second end 224; the second rib part 400 includes a first end 410 and an opposing second end 413; and the third rib part 600 includes a first end 602 and an opposing second end 604.

The attachments between the rib parts 220, 400, 600 are of a pivotal nature to allow the rib assembly 200 to both open and close. More specifically and as described herein, a pivotal joint or the like can be provided between the respective parts to allow the desired rib action when the rib assembly both opens (expands) and closes (collapses).

The first end 222 of the first rib part 220 is pivotally connected to the top cap and the second end 224 is connected to the first end 410 of the second rib part 400 at a pivot joint (pivot point) 414. This pivot joint allows the first rib part 220 and second rib part 400 to pivot between a fully closed position and a fully opened position.

A second strut 230 is also provided and extends between the first strut 210 and the second rib part 400. More specifically, the second strut 230 has a first end 232 and an opposing second end 234. The first end 232 is pivotally attached to the second end 214 of the first strut 210 at a pivot 215. The second end 234 is pivotally attached to the first end 410 of the second rib part 400 at a pivot 412. Along a top surface of the second strut 230 at or near the first end 232, the second strut 230 has a coupling member 242 that can be in the form of a hook or the like. The hook 242 faces the first rib part 220.

A biasing member 240 is biasedly attached between the second strut 230 and the first rib part 220. The biasing member 240 can comprise an elongated spring that is attached at its first end to the hook 242 and is attached at its second end to the first rib part 220 at a connection point 244. The first rib part 220 can have a C-shaped cross-section and therefore there is a center channel into which the biasing member 240 can be received as shown in FIGS. 2-6. The biasing member 240 thus applies a biasing force to the second strut 230 and the first rib part 220. In particular, when the umbrella 100 is being closed, the biasing member 240 can act to draw the second strut 230 toward the first rib part 220.

Along a top surface of the first rib part 220 there is a coupling member 247. The coupling member 247 can be in the form of an eyelet.

As mentioned, the first end 410 of the second rib part 400 is pivotally attached to both the first rib part 220 and the second strut 230 and the second end 413 is pivotally attached to a rib joint member 500 as described in more detail below. The second rib part 400 can also have a C-shaped cross-section and thus have a central channel formed therein.

The rib joint member 500 has a first end 502 and a second end 504. The rib joint member 500 has two defined pivotal attachment regions and more particularly, at a first end 502, a first attachment region is defined, while at a second attachment region, the second end 413 is pivotally attached to this second attachment region of the rib joint member 500. The second end 504 of the rib joint member 500 can have a tubular structure to allow receipt of the third rib part 600. The third rib part 600 can have a cylindrical shape and can be in the form of a flexible metal rod. The first end 602 of the third rib part 600 is attached to the second end 504 as by being received within an opening at the second end 504 and then fixedly attached thereto as by using any number of conventional techniques, including bonding, etc.

Unlike the first rib part 220 and the second rib part 400 which both have C-shaped cross-sections and can be formed of metal, the third rib part 600 is more flexible and has a solid structure, such as a cylindrical rod. At the second end 604 of the third rib part 600, a rib tip 610 is provided. The rib tip 610 can be a metal part to which the peripheral edge of the main first canopy 110 is attached. For example, a hole can be formed through the rib tip 610 through which a portion of the first canopy 110 can extend. The rib tip 610 also includes a protrusion 612 that extends along a section of the lower surface of the rib tip 610. The protrusion 612 is preferably formed of the same material as the rib tip 610 since it is integrally formed and has a hollow construction.

The anti-inversion mechanism of the present invention includes a first wire member 300 (wire coupling member for the inner canopy), 310, a second wire member 700 and a third wire member 800.

The first wire member comprises a bent wire structure that is bent so to form a first wire portion 300 and a second wire portion 310 that are extend along one another such that the two free ends of the first wire member are proximate one another since the wire member is bent over itself. The first wire member is passed through the coupling member 247 (eyelet) so as to secure the first wire member to the first rib member 220.

The second wire portion 310 is coupled to the second rib member 400 by a coupling member 415 that is located along the top surface of the second rib member 400. The coupling member 415 can be in the form of a clip or eyelet to which the second wire portion 310 is attached (i.e., the second wire portion 310 extends through a hole in the coupling member 415.

The free end of the first wire portion 300 includes a tip member 302, such as a metal tip member, while the free end of the second wire portion 310 is attached to the rib joint member 500 at pivot 312 at first end 502. As described below, the first end portion 300 is coupled to the secondary canopy 120 as provides a means for preventing inversion of the secondary canopy 120.

The second wire member 700 is an elongated wire (e.g., a metal rod) that has a first end 702 and an opposite second end. The first end 702 can be a bent end that is anchored to the second rib part 400 as by being passed through a bottom of the second rib part 400 into the central channel defined within the second rib part 400 and then fixedly attached therein as by a rivet or the like. The second wire member 700 is only anchored at its first end 702 and thus represents a cantilevered, flexible structure that flexes under applied forces as described herein. The second wire member 700 can be a metal wire (e.g., a metal rod) that is rigid and maintains its form under normal operating conditions. As discussed herein, the third wire member 800 has a much different form in that it more represents a thin wire or metal string that can be readily bent and readily assumes a non-linear shape during normal use. The third wire member 800 has much less rigidity than the second wire member 700 which under normal use maintains it elongated, linear form except for the purposely bent end 702.

At the free end of the second wire member 700, a connector 710 is provided and can be pivotally attached to the free end of the second wire member 700 as by a rivet or the like. The connector 710 can be a plastic hollow structure into which the free end of the second wire member 700 is received. The connector 710 is also attached to the third wire member 800 which is much more flexible and thinner that the rigid metal second wire member 700 and thus can freely bend, etc. The third wire member 800 can be a nylon coated stainless steel wire. Element 711 can represent a means for attaching the connector 710 to the second wire member 700.

A first end 802 of the third wire member 800 is attached to the connector 720 which thus connects the third wire member 800 to the second wire member 700. A second end 804 of the third wire member 800 is attached to the protrusion 612 of the tip rib 610. In this way, the third wire member 800 is attached to the first main canopy 110. It will be appreciated that the third wire member 800 can a colored wire due to colored nylon and in one embodiment, the third wire member 800 has a red color to differentiate what is otherwise a stainless-steel colored or black colored rib mechanism.

The rib assembly can be attached to the first and second canopies 110, 120 in the following manner.

The secondary canopy 120 is attached to the first rib member 220 as by passing an attached thread through hole 241 to anchor the secondary canopy 120 to the first rib member 220. At the inner edge of the first canopy 110 where the center opening is formed, the second canopy 120 can be anchored to the first canopy 110 as by a stitch (thread) which also captures the wire portion 300. This attachment point is located internal to the free end 302 of the wire portion 300 which once against is anchored to the peripheral outer edge of the second canopy 120 using a rib tip at end 302. Thus, the length of the wire portion 300 from the attachment point to the two canopies 110, 120 to the end 302 is not attached to the first canopy 110 and extends thereover and is freely flexible so as to counter inversion forces.

The rib joint member 500 has a hole 315 to which the first canopy 110 is attached as by using a thread that passes through the hole 315 with said thread being attached to the first canopy 110 so as to anchor the first canopy 110.

In addition, the third rib member 600 can be attached to the first canopy 110 using a thread or stitch so as to anchor the third rib member 600 to the first canopy 110.

According to one aspect of the present invention, the anti-inversion mechanism, defined by the wire members 300, 310, 700, 800 is provided and is configured to counter an inversion force that is applied to the umbrella during select operating conditions and in particular, during windy conditions or other adverse conditions. As is well known by users of umbrellas, if a sudden gust of wind is directed upwardly toward the inside of the umbrella, the pressure applied by the wind will invert the canopy causing the ribs to work counterproductively forcing it outwards. The canopy generally assumes a concave shape when inversion occurs and similarly, the ribs are forced to pivot in unintended directions which can result in one or more ribs breaking. This renders the umbrella not usable. The umbrella of the present invention has the anti-inversion mechanism that is made up of several components that are individually discussed above.

The wire/cable 800 can thus be thought of as being an anti-inversion wire that attaches the anti-inversion mechanism to the canopy tip 610 as disclosed herein. The cable 800 can be and preferable is in the form of a nylon coated stainless steel wire. However, other structures may also be suitable such as a Kevlar fiber or other types of high strength fibers.

The wire 700 can thus be configured such that it acts as an anti-inversion spring that applies a counteractive force to resist inversion of the umbrella as a result of a force (e.g., pressure) applied to the underside of the canopy. The anti-inversion spring (wire 700) thus applies a biasing force to maintain the rib assembly and in particular, the third rib part 600, etc., in a normal operating position. This biasing force thus counteracts upward movement of the third rib part 600 as a result on an applied inversion force (e.g., a sudden gust of wind directed upwardly). The strength of the wire 800 prevents the outer peripheral part of the canopy from inverting by lifting upward (which results in stress on the parts and likely breakage).

The ribs parts 220, 400, 600 can be formed of any number of different materials and it will be understood that according to the present invention, the ribs 220, 400, 600 can be formed of two or more different materials. For example, the rib parts 220, 400 can be formed of a metal, such as aluminum; however, in accordance with one aspect of the present invention, the rib part 600 can be formed of a carbon material (e.g., flutted carbon).

Figure 5:
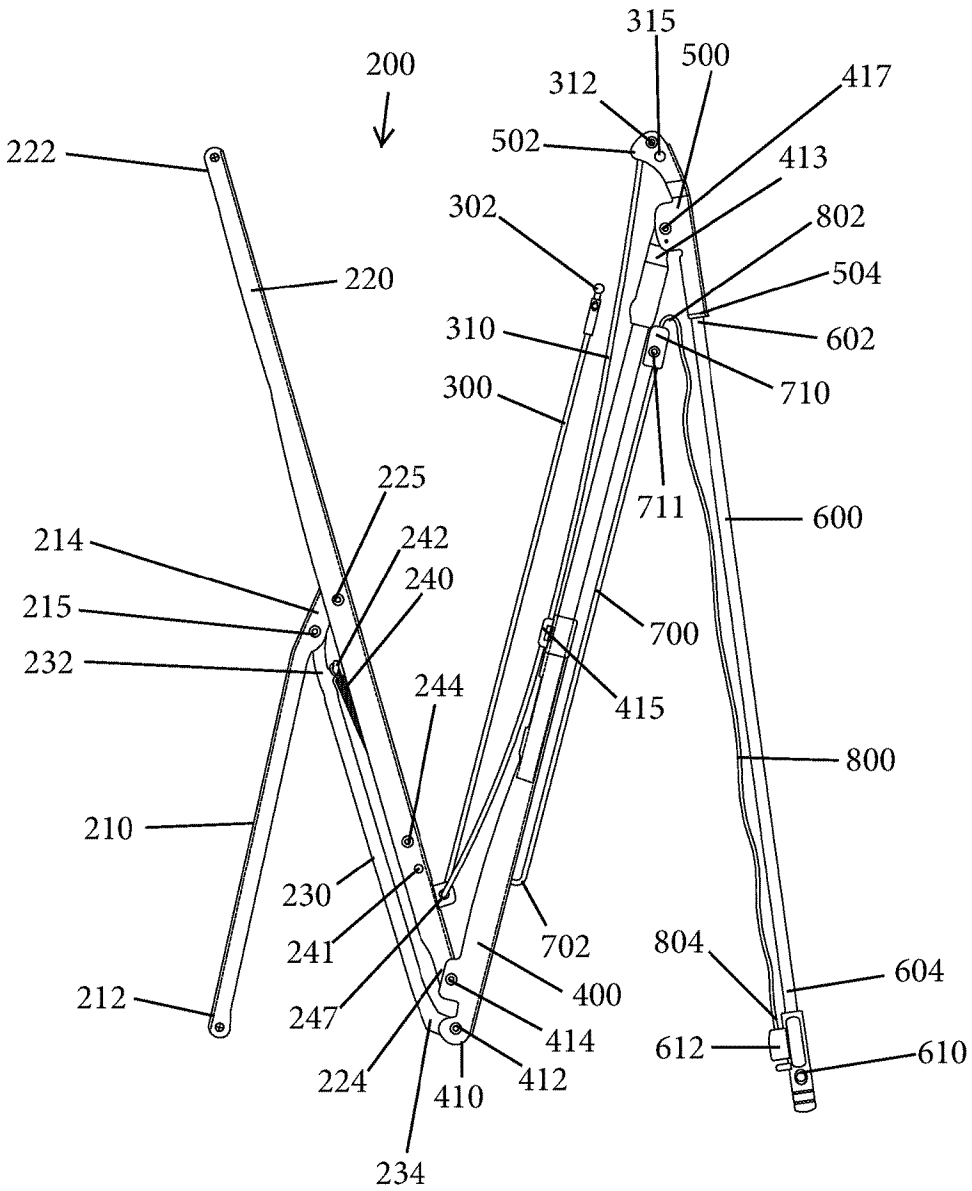
FIG. 5 is a side view of an anti-inversion mechanism.
Figure 6:
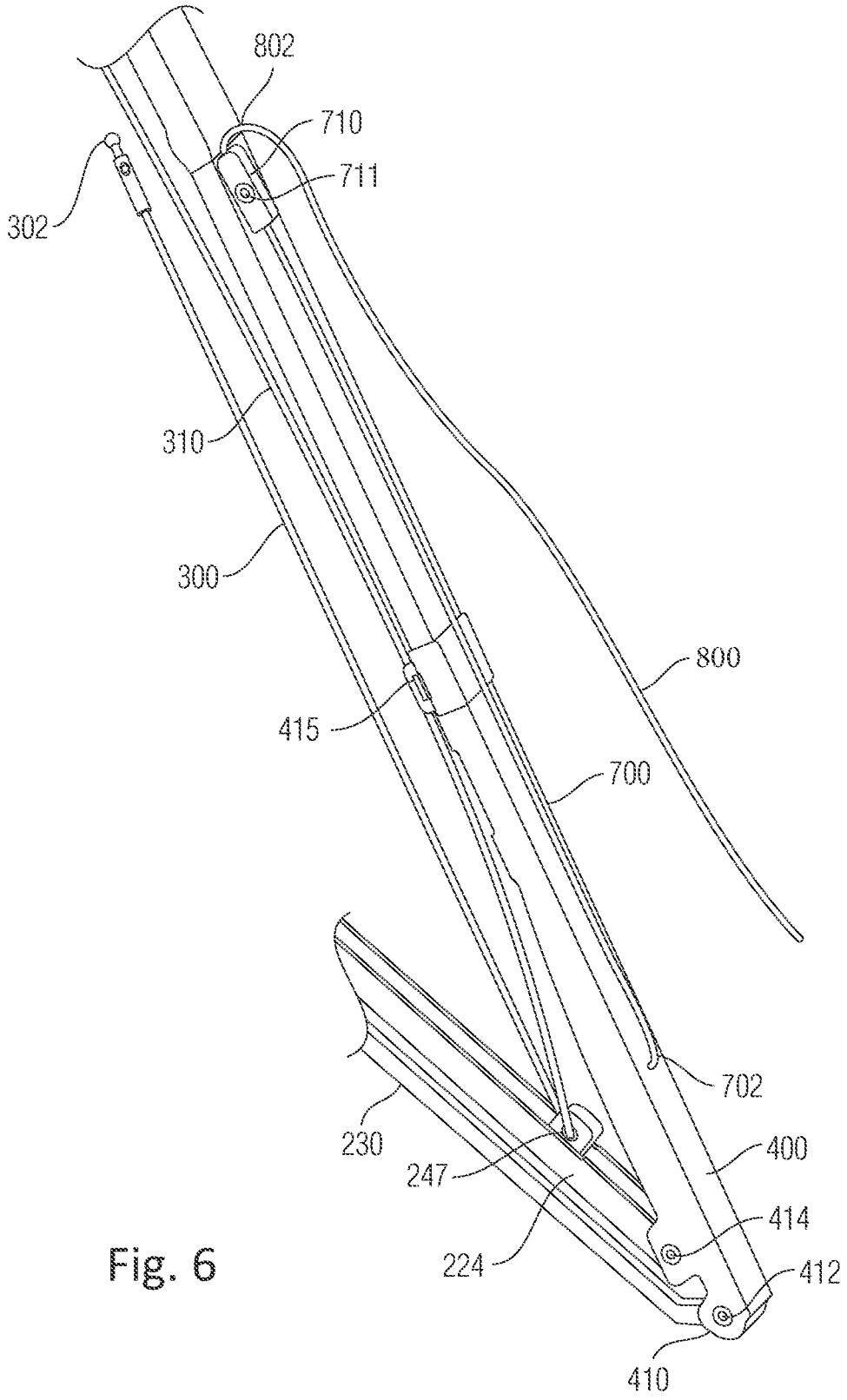
FIG. 6 is a close-up of a portion of the anti-inversion mechanism.

As shown in FIG. 5, in the collapsed state, the second wire member 700 is positioned proximate (adjacent and running parallel to) the second rib part 400. However, in the fully opened position, the free end of the second wire member 700 flexes downward from the second rib part 400 and is spaced therefrom and can act as a spring element that stores energy due to it being deflected downward and its cantilevered structure. Likewise, the third wire 800 in the closed state is adjacent and runs parallel to the third rib part 600 as shown; however, in the opened position, the wire 800 is pulled away from the third rib part 600 by the deflected wire member 700 and is thus under tension.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An umbrella comprising:

an elongated shaft having a first end and an opposite second end;

a runner slidably disposed about the elongated shaft; and a plurality of rib assemblies, each rib assembly including a first rib part, a second rib part and a third rib part, the rib assembly being attached to the runner by a strut that moves between open and closed positions in which in the open position, the first, second and third rib parts are in an open, extended position and in the closed position, the first, second and third rib parts are in a closed, collapsed position;

an anti-inversion mechanism that is configured to apply to each rib assembly a force that counters an inversion force that is applied to the umbrella, the anti-inversion mechanism including a flexible elongated structure that is disposed exteriorly along the second rib part and has a first bent end that is attached to the second rib part by passing through an opening formed in a bottom surface of the second rib part at a location that is spaced distally from a proximal end of the second rib part, the first bent end being anchored within a hollow interior of the second rib part; and a flexible wire having a first end attached to the flexible elongated structure of the anti-inversion mechanism and a second end attached to a rib tip that is located at a free distal end of the rib assembly, wherein the bottom surface of the second rib part is a surface that faces a main portion of the flexible elongated structure that is adjacent the first bent end, the main portion of the flexible elongated structure extending to a second distal end that attaches to the flexible wire.

2. The umbrella of claim 1, wherein the second rib part comprises an elongated metal part that has a C-shape defined by a pair of side walls and a connector wall extending between the pair of side walls, the opening of the second rib part being formed in the connector wall.

3. The umbrella of claim 2, wherein the first bent end is secured to the connector wall with a fastener so as to fixedly attach the first bent end to the second rib part.

4. The umbrella of claim 1, wherein a length of the flexible elongated structure is less than a length of the second rib part.

5. The umbrella of claim 1, wherein the flexible elongated structure comprises a cantilevered member that flexes under applied forces and in response to movement of the flexible wire.

6. The umbrella of claim 1, wherein the second end of the flexible wire is attached to a free distal end of the third rib part.

7. The umbrella of claim 1, wherein the flexible elongated structure comprises a flexible metal rod that in the closed position extends longitudinally along a length of the second rib part in a parallel manner.

8. The umbrella of claim 1, wherein the flexible wire comprises a nylon coated stainless steel wire.

9. The umbrella of claim 1, wherein the rib tip is disposed at a distal end of the third rib part and to which a peripheral edge of an umbrella canopy is attached, the rib tip having a hole formed therethrough through which a portion of the canopy extends, the rib tip further including a protrusion that extends along a section of a lower surface of the rib tip, the second end of the flexible wire being attached to the protrusion.

10. The umbrella of claim 1, further including a first canopy and a second canopy that overlies a center opening formed in the first canopy to provide a vent therebetween, the first canopy extending radially beyond the second canopy, wherein the third rib part is attached to the first canopy and a wire coupling member is attached between the second canopy and a rib joint that pivotally attaches the second rib part to the third rib part.

11. The umbrella of claim 10, wherein the first coupler comprises an eyelet defining a bounded opening through which the wire coupling member passes.

12. The umbrella of claim 1, wherein the flexible wire comprises a cable.

13. An umbrella comprising:

an elongated shaft having a first end and an opposite second end;

a runner slidably disposed about the elongated shaft; and a plurality of rib assemblies, each rib assembly including a first rib part, a second rib part and a third rib part, the rib assembly being attached to the runner by a strut that moves between open and closed positions in which in the open position, the first, second and third rib parts are in an open, extended position and in the closed position, the first, second and third rib parts are in a closed, collapsed position;

an anti-inversion mechanism that is configured to apply to each rib assembly a force that counters an inversion force that is applied to the umbrella, the anti-inversion mechanism including a flexible elongated structure that is disposed exteriorly along the second rib part and has a first bent end that is attached to the second rib part by passing through an opening formed in the second rib part and being anchored within a hollow interior of the second rib part; and a flexible wire having a first end attached to the flexible elongated structure of the anti-inversion mechanism and a second end attached to a rib tip that is located at a free distal end of the rib assembly;

a first canopy and a second canopy that overlies a center opening formed in the first canopy to provide a vent therebetween, the first canopy extending radially beyond the second canopy, wherein the third rib part is attached to the first canopy and a wire coupling member is attached between the second canopy and a rib joint that pivotally attaches the second rib part to the third rib part;

wherein the wire coupling member comprises a wire that has a first end attached to the rib joint and a length that extends along the second rib part and passes through a first coupler that is part of first rib part and attaches at an opposing second end to the second canopy.

14. The umbrella of claim 13, wherein the wire coupling member passes through a second coupler that is part of the second rib part.

15. An umbrella comprising:

an elongated shaft having a first end and an opposite second end;

a runner slidably disposed about the elongated shaft; and a plurality of rib assemblies, each rib assembly including a first rib part, a second rib part and a third rib part, the rib assembly being attached to the runner by a strut that moves between open and closed positions in which in the open position, the first, second and third rib parts are in an open, extended position and in the closed position, the first, second and third rib parts are in a closed, collapsed position;

an anti-inversion mechanism that is configured to apply to each rib assembly a force that counters an inversion force that is applied to the umbrella, the anti-inversion mechanism including a flexible elongated structure that is disposed exteriorly along the second rib part and has a first bent end that is attached to the second rib part by passing through an opening formed in the second rib part and being anchored within a hollow interior of the second rib part; and a flexible wire having a first end attached to the flexible elongated structure of the anti-inversion mechanism and a second end attached to a rib tip that is located at a free distal end of the rib assembly;

wherein the second rib part comprises a metal C-shaped structure that is disposed between the first rib part and the third rib part which comprises a distalmost rib of the rib assembly, the metal C-shaped structure being defined by a pair of opposing parallel side walls and a connector wall that extends between and connects to the opposing parallel side walls, the flexible elongated structure comprising a metal wire that is only attached to the second rib part at the bent first end so as to form a cantilevered structure, the bent first end being in contact with the connector wall that is arranged so as to directly face the third rib part in the closed position.

16. The umbrella of claim 15, wherein the opening formed in the second rib part comprises an opening formed through the connector wall and the bent first end is anchored to the second rib part at a location between the opposing side walls.

* * * * *